US010090103B2

(12) United States Patent
Takahashi et al.

(10) Patent No.: US 10,090,103 B2
(45) Date of Patent: Oct. 2, 2018

(54) METHOD FOR MANUFACTURING RARE-EARTH MAGNETS

(71) Applicant: TOYOTA JIDOSHA KABUSHIKI KAISHA, Toyota-shi, Aichi (JP)

(72) Inventors: Takaaki Takahashi, Toyota (JP); Osamu Yamashita, Toyota (JP); Noriyuki Ueno, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 426 days.

(21) Appl. No.: 14/833,803

(22) Filed: Aug. 24, 2015

(65) Prior Publication Data

US 2016/0104572 A1 Apr. 14, 2016

(30) Foreign Application Priority Data

Oct. 9, 2014 (JP) ..... 2014-208249

(51) Int. Cl.
*H01F 41/02* (2006.01)
*B22F 3/24* (2006.01)
(Continued)

(52) U.S. Cl.
CPC ..... *H01F 41/0266* (2013.01); *B22F 3/003* (2013.01); *B22F 3/16* (2013.01);
(Continued)

(58) Field of Classification Search
None
See application file for complete search history.

(56) References Cited

U.S. PATENT DOCUMENTS 5,162,063 A 11/1992 Shinoda et al.
2011/0302978 A1* 12/2011 Oppenheimer ..... B21C 23/32 72/41
2013/0078369 A1* 3/2013 Shoji ..... H01F 1/0576 427/127

FOREIGN PATENT DOCUMENTS

JP 2-138706 A 5/1990
JP 3-241705 A 10/1991
(Continued)

*Primary Examiner* — Xiaowei Su
(74) *Attorney, Agent, or Firm* — Sughrue Mion, PLLC

(57) ABSTRACT

Provided is a method for manufacturing a rare-earth magnet capable of preventing the lubricant from flowing down during hot deformation processing, whereby friction force can be made as uniform as possible at the overall region of the sintered body, and so the rare-earth magnet manufactured can have less distribution of magnetic performance. A method for manufacturing a rare-earth magnet includes: a first step of sintering magnetic powder MF as a material of the rare-earth magnet to prepare a sintered body S; and a second step of placing the sintered body S in a cavity K of a forming die M made up of a die D and a lower punch P and/or an upper punch P sliding in the die D, and performing hot deformation processing of the sintered body S to give magnetic anisotropy to the sintered body to manufacture the rare-earth magnet C. In the second step, a lubrication sheet 10 is disposed between a side face of each of the lower and the upper punches P, P facing the cavity K and the sintered body S, the lubrication sheet including a pair of graphite sheets 11 and glass-based lubricant 12 sandwiched therebetween, and the hot deformation processing is performed while sandwiching the sintered body S between the upper and the lower lubrication sheets 10.

3 Claims, 11 Drawing Sheets

(51) Int. Cl.

| | |
|---|---|
| ***H01F 1/053*** | (2006.01) |
| ***B22F 3/12*** | (2006.01) |
| ***B22F 3/00*** | (2006.01) |
| ***B22F 3/16*** | (2006.01) |
| ***H01F 1/057*** | (2006.01) |

(52) U.S. Cl.
CPC ..... *H01F 1/0576* (2013.01); *B22F 2998/10* (2013.01); *C22C 2202/02* (2013.01); *H01F 1/0577* (2013.01)

(56) References Cited

FOREIGN PATENT DOCUMENTS

| | | | |
|---|---|---|---|
| JP | 9-129465 | A | 5/1997 |
| JP | 2013-530047 | A | 7/2013 |

* cited by examiner

METHOD FOR MANUFACTURING RARE-EARTH MAGNETS

CLAIM OF PRIORITY

The present application claims priority from Japanese patent application JP 2014-208249 filed on Oct. 9, 2014, the content of which is hereby incorporated by reference into this application.

BACKGROUND

Technical Field

The present invention relates to a method for manufacturing a rare-earth magnet.

Background Art

Rare-earth magnets containing rare-earth elements such as lanthanoide are called permanent magnets as well, and are used for motors making up a hard disk and a MRI as well as for driving motors for hybrid vehicles, electric vehicles and the like.

Indexes for magnet performance of such rare-earth magnets include remanence (residual flux density) and a coercive force. Meanwhile, as the amount of heat generated at a motor increases because of the trend to more compact motors and higher current density, rare-earth magnets included in the motors also are required to have improved heat resistance, and one of important research challenges in the relating technical field is how to keep magnetic characteristics of a magnet operating at high temperatures.

Rare-earth magnets include typical sintered magnets including crystalline grains (main phase) of about 3 to 5 μm in scale making up the structure and nano-crystalline magnets including finer crystalline grains of about 50 nm to 300 nm in nano-scale. Among them, nano-crystalline magnets capable of decreasing the amount of expensive heavy rare-earth elements to be added or without such heavy rare-earth elements added while making the crystalline grains finer attract attention currently.

The following briefly describes one example of the method for manufacturing a rare-earth magnet. In a typical method, for instance, Nd—Fe—B molten metal is solidified rapidly to be fine powder (magnetic powder), while pressing-forming the fine powder to be a sintered body. Hot deformation processing is then performed to this sintered body to give magnetic anisotropy thereto to prepare a rare-earth magnet (orientational magnet). The hot deformation processing is performed by extrusion such as backward extrusion or forward extrusion, or upsetting (forging), for example. Patent Document 1 also discloses a method to orient crystalline grains through hot deformation processing to manufacture a rare-earth magnet having high degree of magnetization and high coercive force.

Herein the hot deformation processing is performed by placing a sintered body in a cavity of a forming die made up of a die and a lower punch and/or an upper punch sliding in the die, for example, and hot-pressing the sintered body while sliding the upper punch, for example. At this time, glass-based lubricant or lubricant containing the mixture of glass-based lubricant (e.g., glass powder) and graphite powder is used as lubricant that can be used in a high-temperature atmosphere as well, and such lubricant is applied or sprayed on side faces of the die or the punch defining the cavity for hot deformation processing.

Such hot deformation processing, however, has the problem that the glass-based lubricant changes to liquid phase during the processing, so that the viscosity of the lubricant applied or the like on side faces of the die and the punch facing the cavity decreases and the lubricant flows down, thus causing a breakage of the film and failing to exert sufficient lubricity. This makes frictional force different between an area where the lubricant flows down and a region where the lubricant remains on the side faces facing the cavity, and makes pressing force acting on the sintered body different therebetween. In this way, non-uniform pressing force acts on the sintered body, so that deformability also varies from one place to another (uniform processing strain cannot be given), and a rare-earth magnet manufactured has different magnetic performance from one place to another.

For instance, in hot deformation processing to give deformation at the draft of 70% to a sintered body in the temperature atmosphere at 650° C., high-viscosity lubricant of about $1\times10^3$ Pas is required so as not to flow down from the cavity face. Although glass-based lubricant to meet this condition can be prepared, then it is difficult to apply or the like such high-viscosity glass-based lubricant to the cavity face, and so this cannot be said a practical method.

Another possible method is to readjust the processing conditions of hot deformation processing, including strain rate, pressing load and processing temperature to find the conditions to suppress flowing-down of glass-based lubricant. Such factors of strain rate, pressing load and processing temperature, however, are all important for the degree of orientation of a magnet, and so it is not easy to readjust these factors.

RELATED ART DOCUMENTS

Patent Document

Patent Document 1: JP H02-138706 A

SUMMARY

In view of the aforementioned problems, the present invention aims to provide a method for manufacturing a rare-earth magnet, including placing a sintered body in a cavity of a forming die, and manufacturing a rare-earth magnet through hot deformation processing, the method preventing flow-down of lubricant during the hot deformation processing and minimizing friction force between the cavity side faces and the sintered body to give as uniform processing strain as possible to the overall area of the sintered body, and so enable the manufacturing of a rare-earth magnet with less magnetic performance distribution.

In order to fulfill this object, a method for manufacturing a rare-earth magnet of the present invention includes: a first step of sintering magnetic powder as a material of the rare-earth magnet to prepare a sintered body; and a second step of placing the sintered body in a cavity of a forming die made up of a die and a lower punch and/or an upper punch sliding in the die, and performing hot deformation processing of the sintered body to give magnetic anisotropy to the sintered body to manufacture the rare-earth magnet. In the second step, a lubrication sheet is disposed between a side face of each of the lower and the upper punches facing the cavity and the sintered body, the lubrication sheet including a pair of graphite sheets and glass-based lubricant sandwiched therebetween, and the hot deformation processing is performed while sandwiching the sintered body between the upper and the lower lubrication sheets.

The method for manufacturing a rare-earth magnet of the present invention includes: before hot deformation processing of a sintered body, disposing a lubrication sheet between a side face of each of the lower and the upper punches of the forming die facing the cavity and the sintered body, the lubrication sheet including a pair of graphite sheets and glass-based lubricant sandwiched therebetween, and performing hot pressing while sandwiching the sintered body between the upper and the lower lubrication sheets. Such a method can prevent the lubricant from flowing down even in a high-temperature atmosphere, and so friction force between the sintered body and the upper and lower punches can be reduced, and the friction force can be made as uniform as possible at the overall region of the sintered body, so that the overall region of the sintered body can be given as uniform processing strain as possible. Herein "disposing a lubrication sheet between a side face of each of the lower and the upper punches of the forming die facing the cavity and the sintered body, the lubrication sheet including a pair of graphite sheets and glass-based lubricant sandwiched therebetween" includes the form of directly attaching the lubrication sheet to the side faces of the lower punch and the upper punch facing the cavity and the form of directly attaching two of the lubrication sheets to the upper and lower faces of the sintered body. In either form, the lubrication sheet can be disposed between the punches and the sintered body.

Glass-based lubricant (e.g., glass powder) included in the lubrication sheet shows liquid phase in the temperature atmosphere of 600° C. or higher, for example, to be low-viscosity fluid lubricant. On the other hand, a pair of graphite sheets sandwiching the glass-based lubricant can keep a solid-phase state in the temperature atmosphere during hot deformation processing as well. This means that the lubrication sheet has apparent viscosity higher than that of the glass-based lubricant only, and so the disposed state on the side faces of the upper and lower punches facing the cavity can be kept, which can prevent the problem such as flowing-down of the lubrication sheet disposed at the cavity faces of the upper punch.

Graphite included in the graphite sheets has a scale-like shape, so that these scales are overlapped with each other, from which favorable lubricity can be brought to the cavity faces.

Such lubrication sheets used can lead to favorable lubricity, enabling uniform pressing at the upper and lower faces, for example, of the sintered body, and so introduce uniform processing strain to the upper and lower faces. In this way, there is no need to readjust the factors of strain rate, pressing load and processing temperature as processing conditions for hot deformation processing.

Measures to suppress friction force between side faces of the upper and lower punches facing the cavity and the sintered body may include to improve the performance of lubricant, to improve the application state of lubricant to the cavity side faces or the like, to improve the surface roughness of the cavity side faces, to optimize the shape of the cavity (e.g., to be tapered for easy flowing-down of a material), to improve the surface roughness of the sintered body, to optimize the shape of the sintered body (set so that sliding distance can be reduced during the hot deformation processing), and to reduce deformation resistance of the sintered body. Then the present invention uses the measure to improve the performance of lubricant that is the most practical among them. Further, while improving the performance of lubricant, the present invention does not use lubricant made of any innovative new material, but uses lubricant including a pair of graphite sheets and glass-based lubricant sandwiched therebetween, and so the manufacturing cost including material cost is not expensive.

The manufacturing method of the present invention performs hot deformation processing while sandwiching the sintered body between the upper and lower lubrication sheets, and lubrication sheets may be disposed at the side faces of the sintered body (side faces of the sintered body facing the lateral die) as well. That is, hot pressing of the sintered body may be performed while disposing lubrication sheets at all side faces of a hexahedral sintered body, for example. Note herein that the cavity and the sintered body are designed to have dimensions so as to leave a constant gap between the sintered body and the side faces of the die facing the cavity when the sintered body is placed in the cavity of the forming die. Then after hot deformation processing as well, the cavity and the rare-earth magnet subjected to the hot deformation processing are designed to have dimensions so as to leave a gap between the rare-earth magnet manufactured and the side faces of the die facing the cavity. That is, there may be no need to dispose lubrication sheets on the side faces of the sintered body, but considering the case where the side faces of the sintered body come into contact with the side faces of the die during hot deformation processing, such lubrication sheets disposed at the side faces of the sintered body have an advantageous effect.

In the manufacturing method of the present invention, a lubrication sheet including a pair of graphite sheets and glass-based lubricant sandwiched therebetween is used, in other words, lubricant including the mixture of graphite powder and glass powder is not used because, in the latter case of using mixed powder, glass powder may be molten in the high-temperature atmosphere during hot deformation processing, and the flow of such melt may carry the graphite powder. On the other hand, in the case of using a graphite sheet, such a problem does not occur.

As can be understood from the descriptions, the method for manufacturing a rare-earth magnet of the present invention includes, before hot deformation processing of a sintered body, disposing a lubrication sheet at side faces the lower and the upper punches of the forming die facing the cavity, the lubrication sheet including a pair of graphite sheets and glass-based lubricant sandwiched therebetween, and performing hot pressing while sandwiching the sintered body between the upper and the lower lubrication sheets. Such a method can prevent the lubricant from flowing down even in a high-temperature atmosphere. Then friction force between the sintered body and the upper and lower punches can be reduced, and the friction force can be made as uniform as possible at the overall region of the sintered body, so that the overall region of the sintered body can be given as uniform processing strain as possible. This enables the rare-earth magnet manufactured to have high degree of orientation at the entire region, and have both of excellent degree of magnetization and coercive force.

DETAILED DESCRIPTION OF THE EMBODIMENT(S)

The following describes an embodiment of a method for manufacturing a rare-earth magnet of the present invention, with reference to the drawings. For the purpose of illustration, the drawings show the case of performing hot deformation processing using a forming die that is used for sintering of a sintered boy, and different forming dies may be used for sintering magnetic powder to manufacture a sintered body and for performing hot deformation processing of the sintered body to manufacture a rare-earth magnet naturally.

(Embodiment of Method for Manufacturing a Rare-Earth Magnet)

Figure 1:
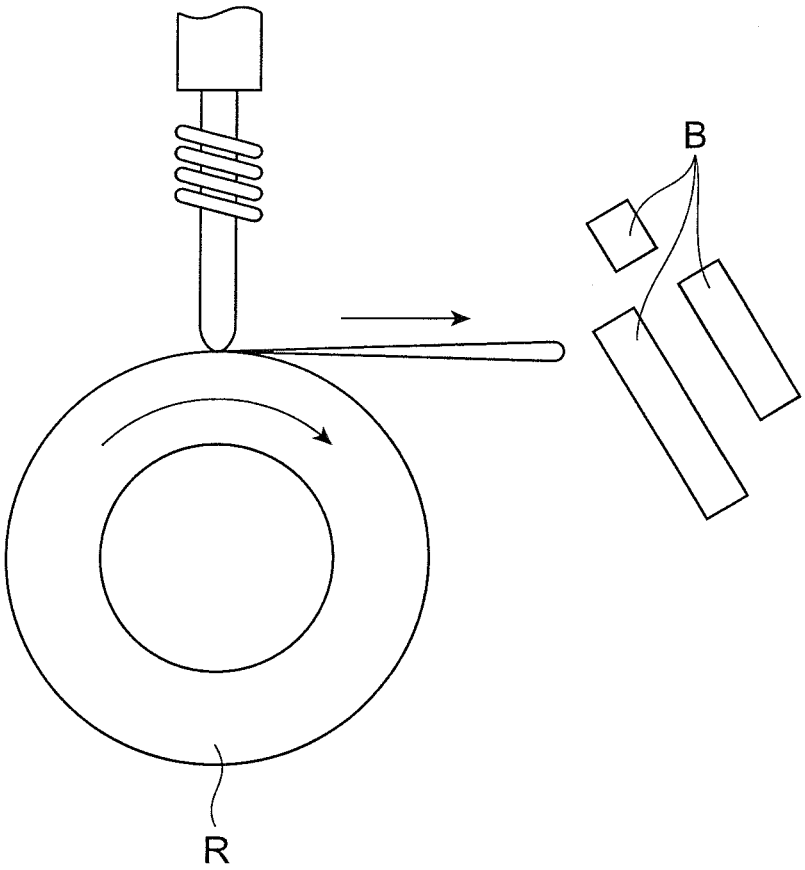
FIG. 1 schematically describes a method for manufacturing magnetic powder that is used in a first step of a method for manufacturing a rare-earth magnet of the present invention.
Figure 2:
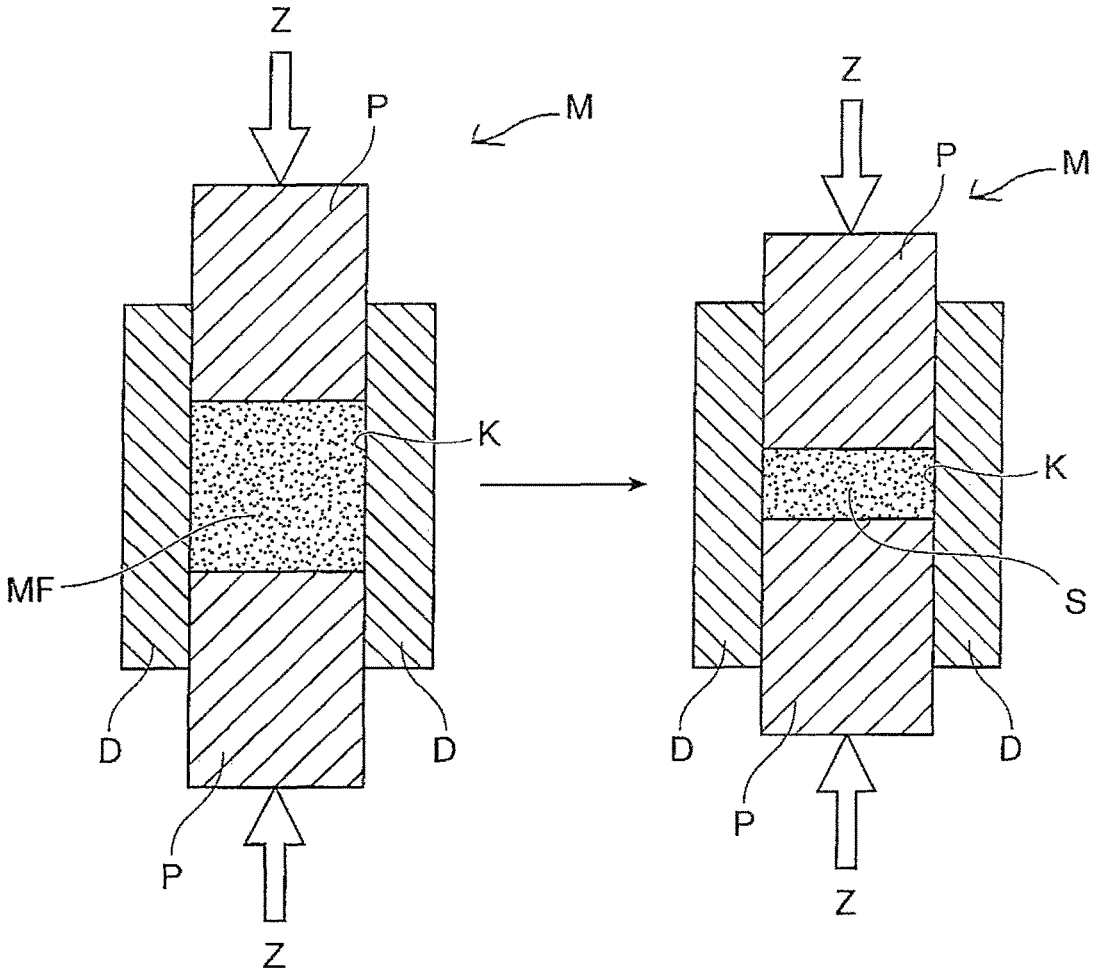
FIG. 2 schematically describes the first step of the method for manufacturing a rare-earth magnet of the present invention.
Figure 3:
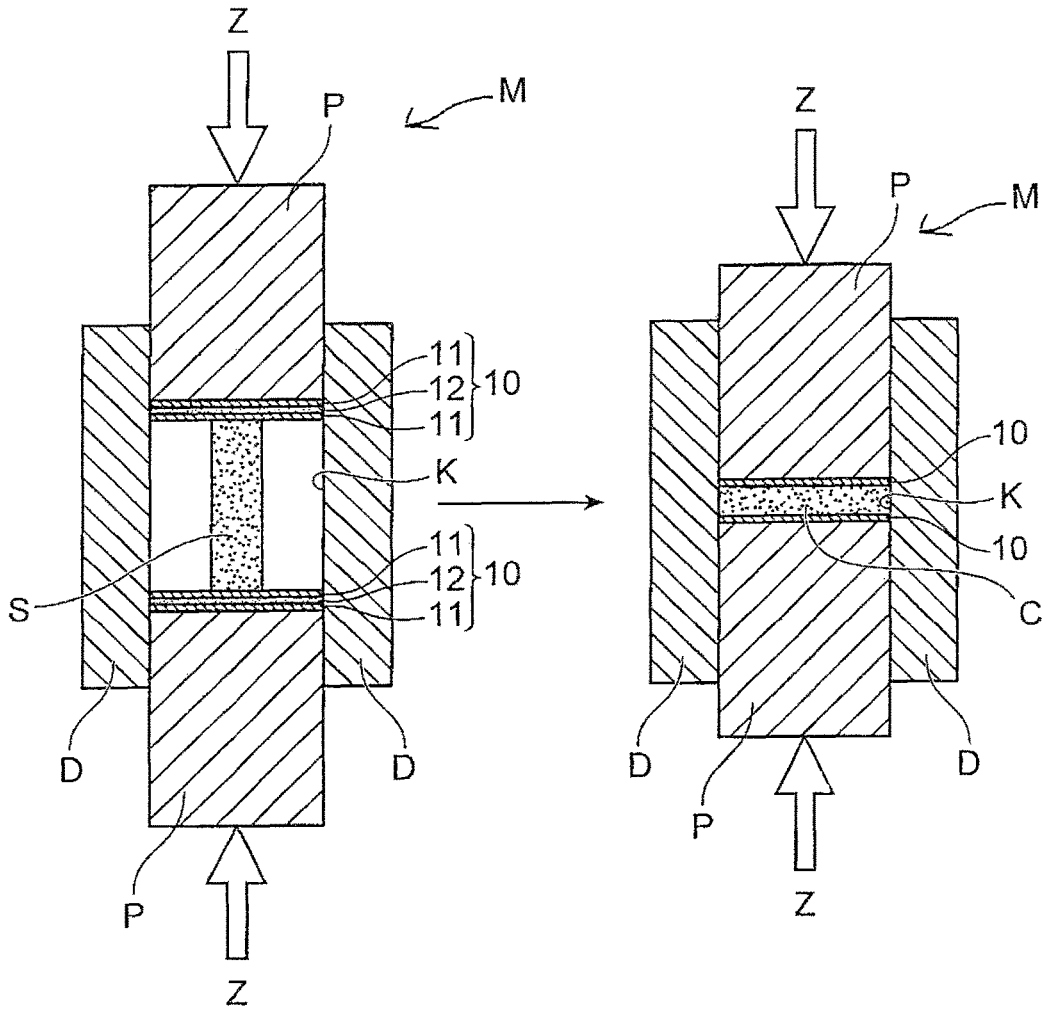
FIG. 3 schematically describes a second step of the method for manufacturing a rare-earth magnet of the present invention.

FIG. 1 schematically describes a method for manufacturing magnetic powder that is used in a first step of a method for manufacturing a rare-earth magnet of the present invention, and FIGS. 2 and 3 schematically describe the first step and a second step, respectively, of the method for manufacturing a rare-earth magnet.

For instance, as illustrated in FIG. 1, alloy ingot is molten at a high frequency, and a molten composition giving a rare-earth magnet is injected to a copper roll R to manufacture a melt-spun ribbon B (rapidly quenched ribbon) by a melt-spun method using a single roll in an oven (not illustrated) at reduced pressure of 50 kPa or lower, for example.

The melt-spun ribbon B obtained is then coarse-ground to prepare magnetic powder. At this time, the magnetic powder has the adjusted grain size that is in the range from 75 to 300 μm.

Next as illustrated in FIG. 2, magnetic powder MF is placed (loaded) in a cavity K of a forming die M made up of a carbide die D and a carbide punch P sliding along the hollow of the carbon die. Then ormic-heating at about 700° C. is performed while applying pressure with the carbide punch P (Z direction) and letting current flow through in the pressuring direction (hot forming, sintering), whereby a sintered body S is prepared (first step). This sintered body S, for example, includes a Nd—Fe—B main phase (having the average grain size of 300 nm or less, and having the crystalline grain size of about 50 nm to 200 nm) of a nano-crystalline structure and a Nd—X alloy (X: metal element) grain boundary phase around the main phase.

Herein, the Nd—X alloy making up the grain boundary phase of the sintered boy S is an alloy containing Nd and at least one type of Co, Fe, Ga and the like, which may be any one type of Nd—Co, Nd—Fe, Nd—Ga, Nd—Co—Fe, Nd—Co—Fe—Ga, or the mixture of two types or more of them, and is in a Nd-rich state.

Once the sintered body S is prepared in the first step, then the sintered body S is taken out from the forming die M. As illustrated in FIG. 3, a lubrication sheet 10 is then disposed on each of side faces of the lower punch P and the upper punch P facing the cavity K, the lubrication sheet including a pair of graphite sheets 11, 11 and glass-based lubricant 12 sandwiched therebetween, so as to sandwich the sintered body S between the upper and the lower lubrication sheets 10, 10. Alternatively, the lubrication sheets 10 may be disposed on the upper and the lower faces of the sintered body S, and then the sintered body may be placed in the cavity K.

Next, hot deformation processing is performed while pressing with the carbide punch P (Z direction), so as to give magnetic anisotropy to the sintered body S. In this way, a rare-earth magnet C having desired degree of orientation is manufactured (second step).

The rate of strain is favorably adjusted at 0.1/sec. or more during hot deformation processing. When the degree of processing (draft, rate of compression) by the hot deformation processing is large, e.g., when the draft is about 10% or more, such hot deformation processing can be called heavily deformation processing. The hot deformation processing is favorably performed in the range of the draft that is about 60 to 80%.

Figure 4A:
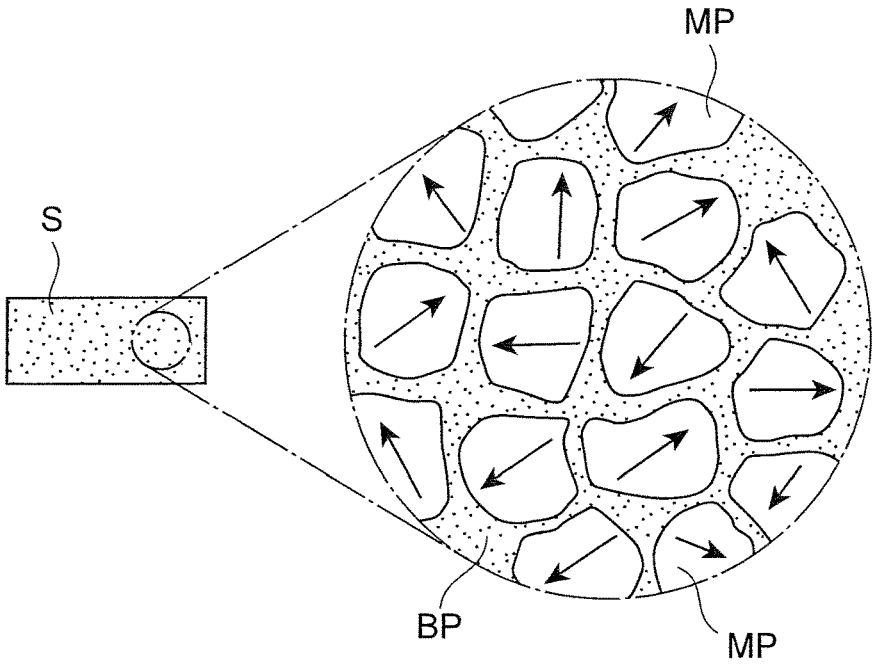
FIG. 4A describes a micro-structure of a sintered body in FIG. 2, and FIG. 4B describes a micro-structure of a rare-earth magnet in FIG. 3.

As illustrated in FIG. 4A, the sintered body S prepared in the second step shows an isotropic crystalline structure where the space between the nano-crystalline grains MP (main phase) is filled with the grain boundary phase BP.

Figure 4B:
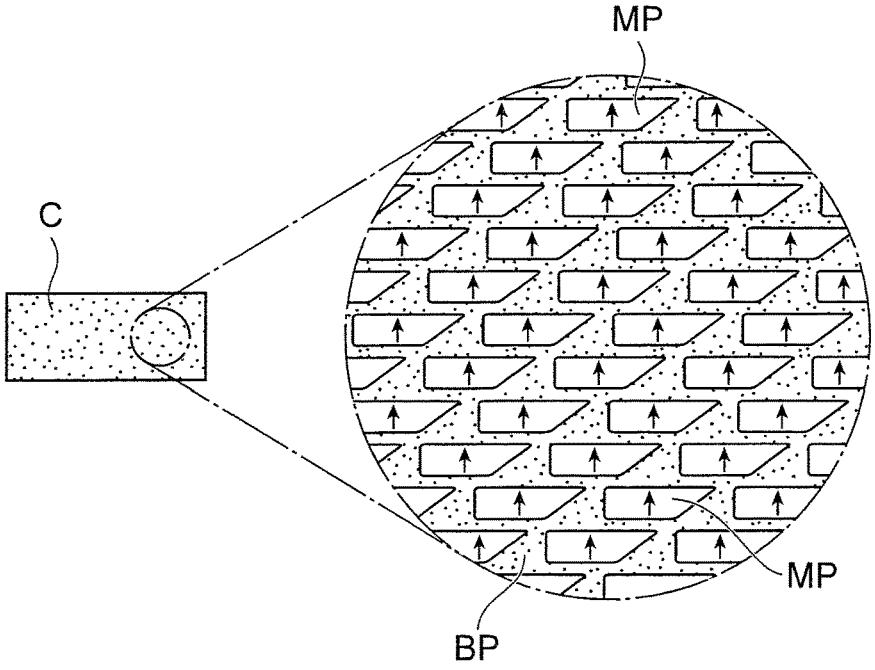

On the other hand, as illustrated in FIG. 4B, the rare-earth magnet C prepared in the second step shows a magnetic anisotropic crystalline structure.

In this way, the method for manufacturing of a rare-earth magnet of the present invention includes the step of hot deformation processing of a sintered body S, in which the lubrication sheet 10 is disposed on each of side faces of the upper and lower punches P of the forming die M facing the cavity K, the lubrication sheet including a pair of graphite sheets 11, 11 and glass-based lubricant 12 sandwiched therebetween, and hot pressing is performed while sandwiching the sintered body S between the upper and the lower lubrication sheets 10, 10. Such a method can prevent the lubricant from flowing down even in a high-temperature atmosphere. That is, friction force between the sintered body S and the upper and lower punches P, P can be reduced, and the friction force given can be made as uniform as possible at the overall region of the sintered body, so that the overall region of the sintered body can be given as uniform processing strain as possible. Then, the rare-earth magnet manufactured can have high degree of orientation at the entire region, and have both of excellent degree of magnetization and coercive force.

(Experiment to Observe Rare-Earth Magnets from the Top Face that are Prepared Using a Graphite Sheet Only for Lubricant and are Prepared Using a Lubrication Sheet Including a Pair of Graphite Sheets and Glass-Based Lubricant Sandwiched Therebetween, and Results Thereof)

The present inventors conducted the experiment to observe rare-earth magnets from the top face that were prepared using a graphite sheet only for lubricant (comparative example) and were prepared using a lubrication sheet including a pair of graphite sheets and glass-based lubricant sandwiched therebetween (example).

<Method for the Experiment>

Two types of sheet-form lubricant as stated above were disposed at cavities of forming dies, followed by sandwiching of sintered bodies between the upper and lower lubricant for hot deformation processing. The graphite sheet of comparative example had a thickness of 200 μm, and the lubrication sheet of example was configured so as to sandwich glass of 100 μm in thickness between upper and lower graphite sheets each having a thickness of 50 μm so that the overall thickness was 200 μm similar to comparative example. The sintered body used was a pre-cursor of Nd—Fe—B rare-earth magnet, to which hot pressing (hot deformation processing) was performed at the draft of 70%.

<Experimental Results>

Figure 5A:
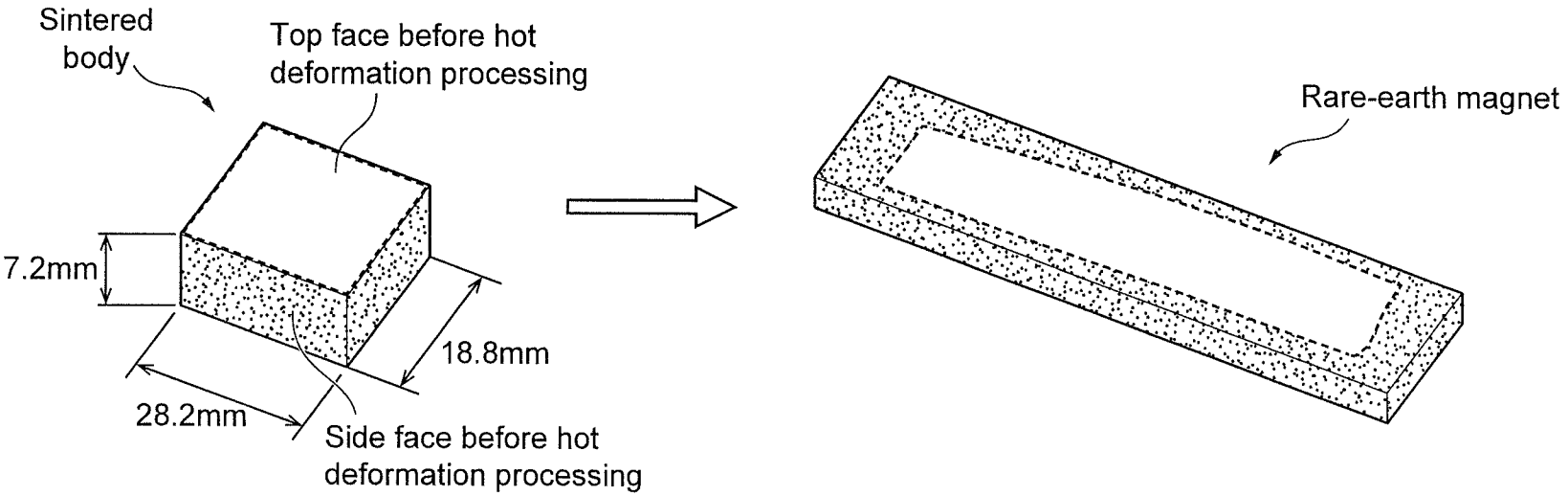
FIG. 5 shows the experimental result when using a lubrication sheet including a graphite sheet only, where FIG. 5A schematically illustrates a sintered body and a rare-earth magnet that is obtained by performing hot deformation processing to the sintered body.
FIG. 5B is a photo taken from the top face of the rare-earth magnet.
Figure 5B:
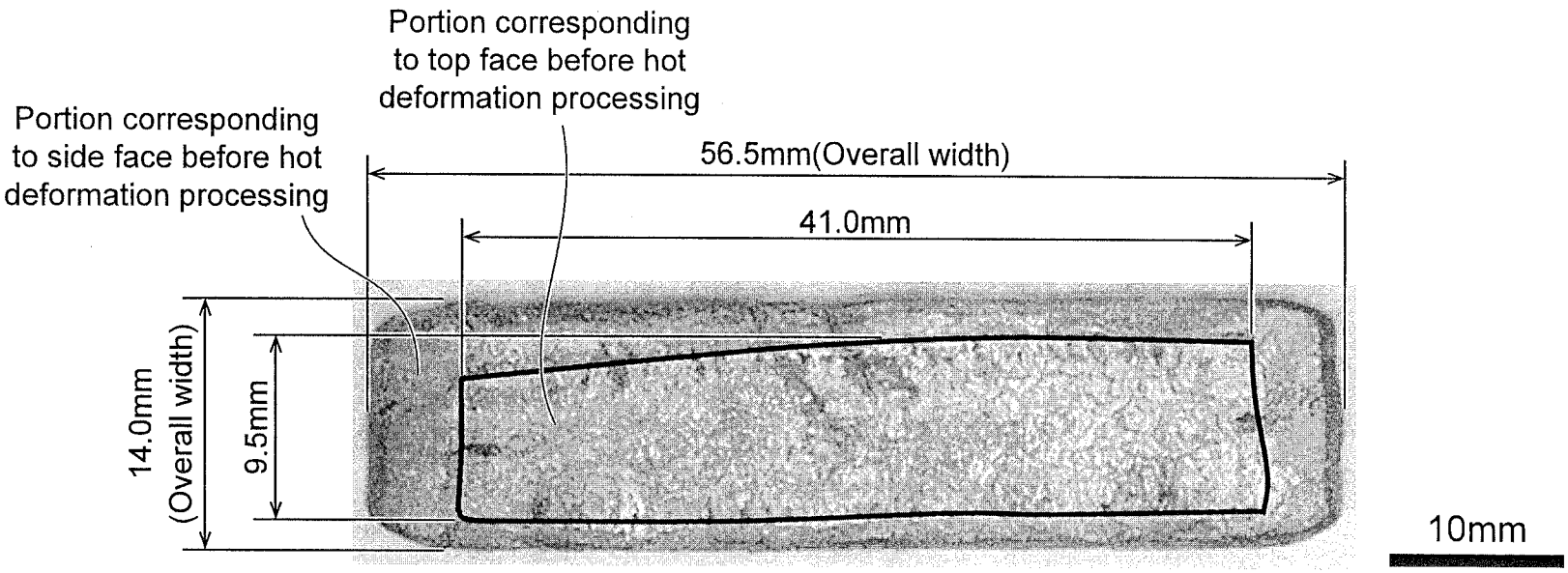
Figure 6A:
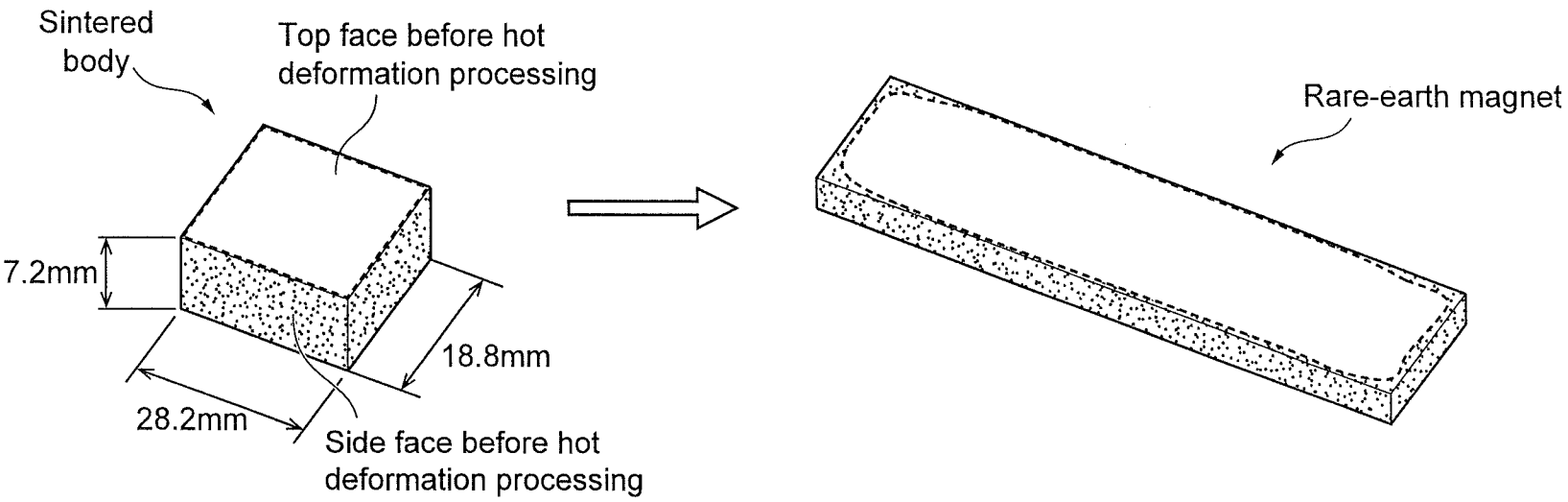
FIG. 6 shows the experimental result when using a lubrication sheet including a pair of graphite sheets and glass-based lubricant sandwiched therebetween, where FIG. 6A schematically illustrates a sintered body and a rare-earth magnet that is obtained by performing hot deformation processing to the sintered body.
FIG. 6B is a photo taken from the top face of the rare-earth magnet.

FIG. 5A schematically illustrates a sintered body of comparative example and a rare-earth magnet that was obtained by performing hot deformation processing to the sintered body, and FIG. 5B is a photo taken from the top face of the rare-earth magnet. FIG. 6A schematically illustrates a sintered body of example and a rare-earth magnet that was obtained by performing hot deformation processing to the sintered body, and FIG. 6B is a photo taken from the top face of the rare-earth magnet.

The figure of FIG. 5A on the right and FIG. 5B indicating the result of comparative example show that lubricating property of comparative example during hot deformation processing was not enough and so the part corresponding to the side face of the sintered body greatly appeared on the top face of the rare-earth magnet.

Figure 6B:
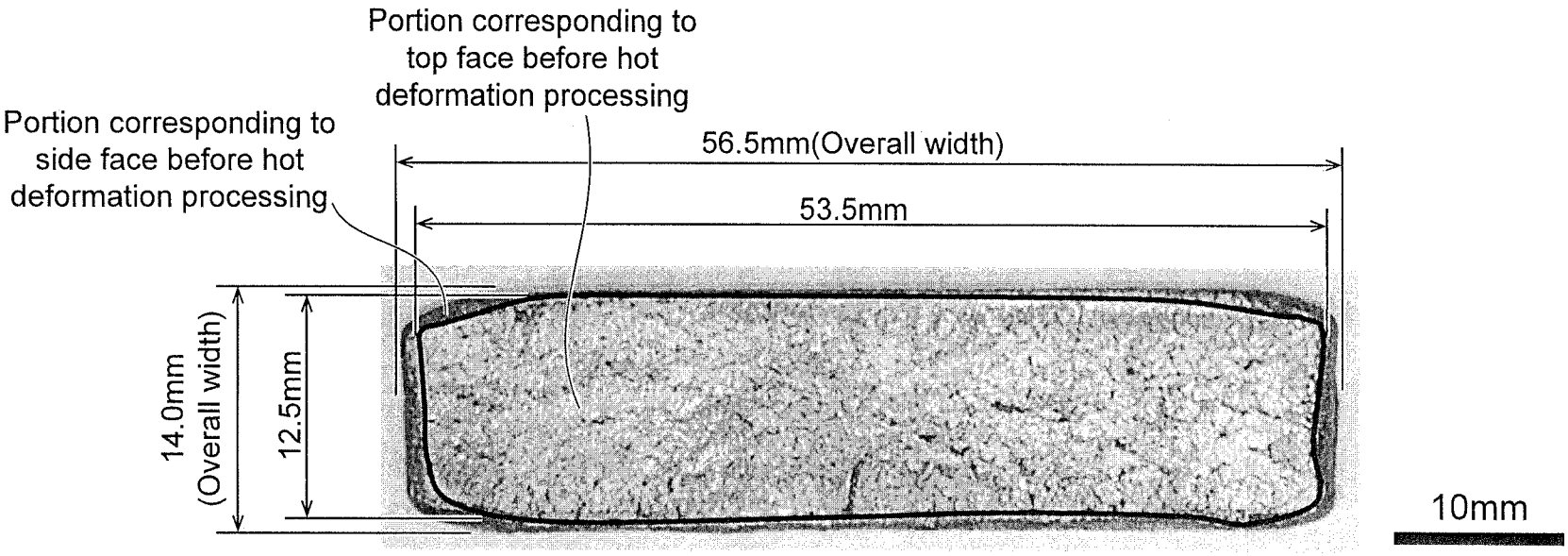

On the other hand, the figure of FIG. 6A on the right and FIG. 6B indicating the result of example show that lubricating property of example during hot deformation processing was enough and so the part corresponding to the side face of the sintered body did not come around to the top face of the rare-earth magnet, and was swollen laterally for deformation.

Then, comparison between FIG. 5B and FIG. 6B, for example, shows that the sintered body of example was deformed laterally substantially uniformly at the four side faces to be the rare-earth magnet compared with comparative example, and presumably favorable wet condition during hot deformation processing contributed to such a result. On the other hand, the rare-earth magnet of comparative example had a different amount of deformation at each side face, meaning a distorted deformation state.

The following considers the reason for using a lubrication sheet including a pair of graphite sheets and glass-based lubricant sandwiched therebetween, i.e., for not using lubricant in which graphite powder and glass powder are mixed.

Figure 7A:
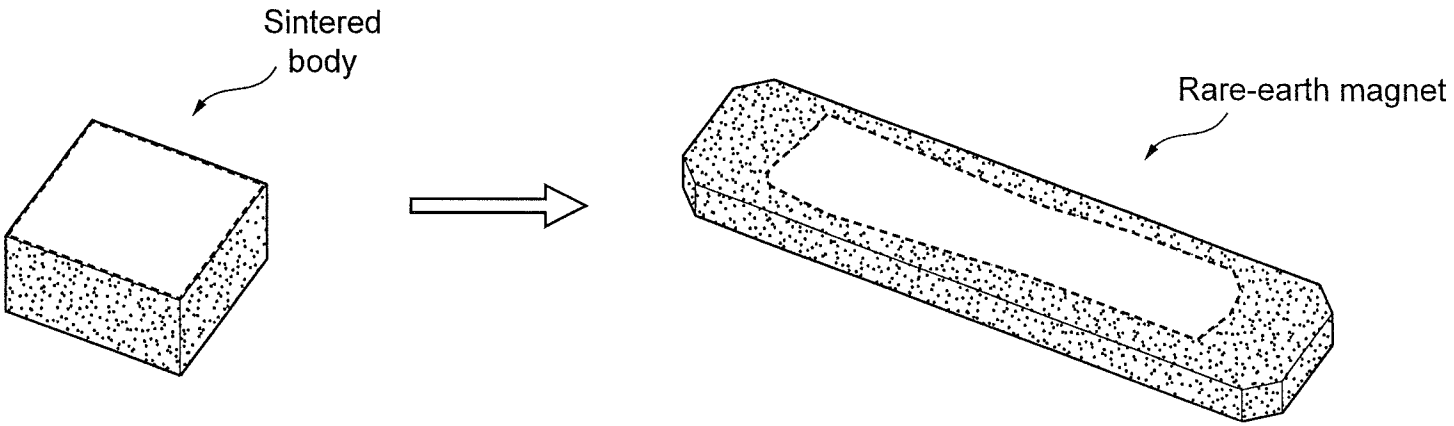
FIG. 7 shows the experimental result when using mixed lubricant of graphite powder and glass powder, where FIG. 7A schematically illustrates a sintered body and a rare-earth magnet that is obtained by performing hot deformation processing to the sintered body.
FIG. 7B is a photo taken from the top face of the rare-earth magnet.
Figure 7B:
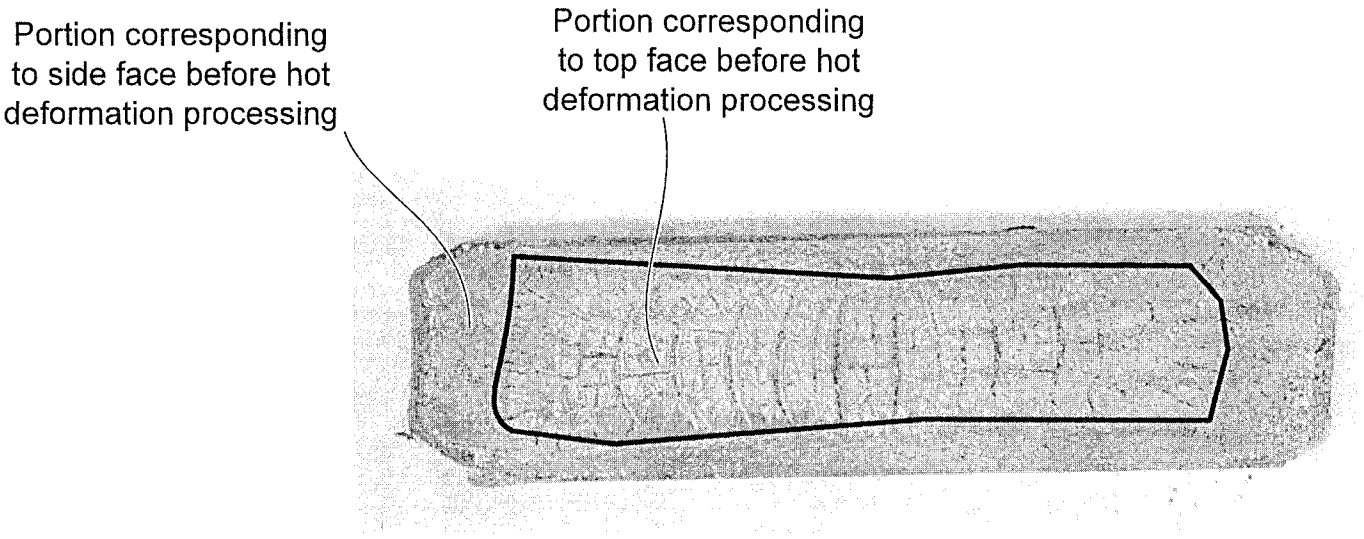

FIG. 7 shows the experimental result using mixed lubricant of graphite powder and glass powder, where FIG. 7A schematically illustrates a sintered body and a rare-earth magnet that was obtained by hot deformation processing of this sintered body, and FIG. 7B is a photo taken from the top face of the rare-earth magnet. The experiment was conducted under the similar conditions to FIGS. 5 and 6.

The figure of FIG. 7A on the right and FIG. 7B show that the part corresponding to the side face of the sintered body before hot deformation processing was extended to the top face of the rare-earth magnet. Presumably this shows that lubricating property during hot deformation processing was not enough. Such insufficient lubricating property results from melting of the glass powder that was included in the mixture lubricant of the graphite powder and the glass powder when being exposed to a high-temperature atmosphere during hot deformation processing, and such glass powder changes into fluid, which carries the graphite powder along the flow to the outside of the forming die, meaning that the lubricant cannot be kept at the surface of the sintered body. As a result, the defective product for forging as in the photo of FIG. 7B was generated presumably.

On the other hand, when using graphite sheets and glass powder sandwiched therebetween as lubricant, glass does not leak as fluid, and hot deformation processing can be performed while keeping the state of the graphite sheets in contact with the surface of the sintered body, and so the lubricant can keep high viscosity required during the hot deformation processing.

In this way, a lubrication sheet that is a combination of graphite sheets and glass powder can be used, which facilitates to dispose such a lubrication sheet on a side face of a punch defining a cavity or on a side face of a sintered body. Such a lubrication sheet can serve as lubricant having high viscosity that can be used even in high-temperature atmosphere.

(Considerations on Frictional Coefficient Between Cavity and Sintered Body when Using a Lubrication Sheet that is a Combination of Graphite Sheets and Glass-Based Lubricant)

Figure 8:
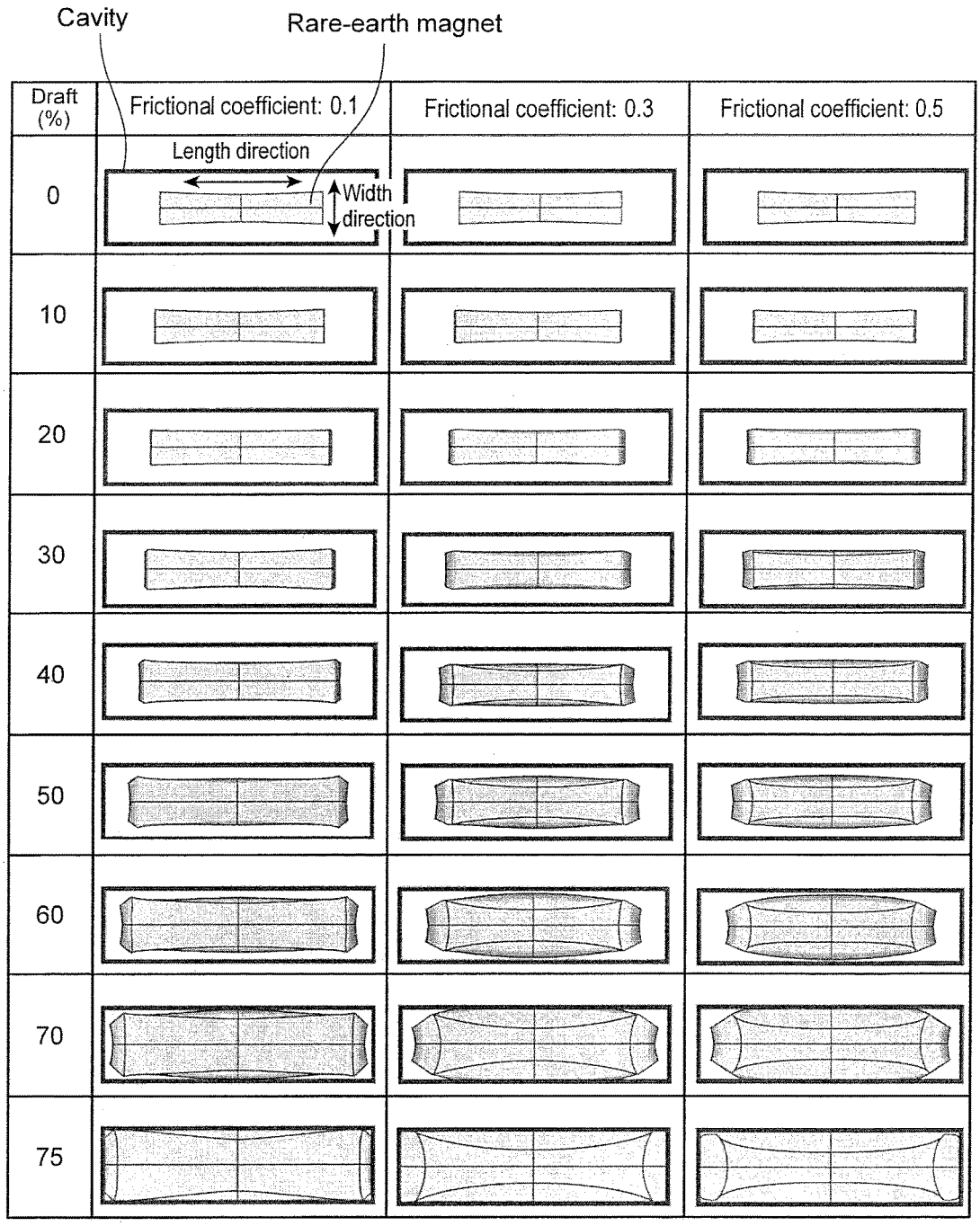
FIG. 8 shows the result of considerations on the frictional coefficient between cavity and sintered body when using a lubrication sheet that is a combination of graphite sheets and glass-based lubricant.

In order to consider the frictional coefficient between cavity and sintered body when using a lubrication sheet that is a combination of graphite sheets and glass-based lubricant, the present inventors conducted CAE analysis. Specifically, the CAE analysis was conducted to quantify the effect on lubricating property from a lubrication sheet that was a combination of graphite sheets and glass powder. The frictional coefficient between a sintered body and a side face of a punch of a forming die and the draft were variously changed, while checking against the shape of FIG. 6, whereby the frictional coefficient was found when the lubrication sheet was used. FIG. 8 shows the result of the CAE analysis.

The rare-earth magnets (sintered bodies) had initial shapes in the top-face view that was a rectangle as indicated in the fields of the draft of 0% in FIG. 8. Checking the CAE result against the shape of the rare-earth magnet of FIG. 6B shows that the shape closest to the actual test piece had the frictional coefficient of 0.1 when the draft was 70%. This result shows that the frictional coefficient during hot deformation processing is about 0.1 when using a lubrication sheet that is a combination of graphite sheets and glass-based lubricant.

Although the embodiments of the present invention have been described in details with reference to the drawings, the specific configuration is not limited to these embodiments, and the design may be modified without departing from the subject matter of the present invention, which falls within the present invention.

DESCRIPTION OF SYMBOLS

10 Lubrication sheet
11 Graphite sheet
12 Glass-based lubricant
MF Magnetic powder
S Sintered body C Rare-earth magnet
R Copper roll
B Melt-spun ribbon (rapidly quenched ribbon)
M Forming die
D Die (carbide die)
P Punch (carbide punch)
K Cavity
GF Graphite-based lubricant (Graphite powder)
MP Main phase (nano-crystalline grains, crystalline grains, crystals)
BP Grain boundary phase

What is claimed is:

1. A method for manufacturing a rare-earth magnet, comprising:

a first step of sintering magnetic powder as a material of the rare-earth magnet to prepare a sintered body; and a second step of placing the sintered body in a cavity of a forming die made up of a die and a lower punch and an upper punch sliding in the die, and performing hot deformation processing of the sintered body to give magnetic anisotropy to the sintered body to manufacture the rare-earth magnet, wherein in the second step, an upper lubrication sheet is disposed between a side face of the upper punch facing the cavity and the sintered body, a lower lubrication sheet is disposed between a side face of the lower punch facing the cavity and the sintered body, the upper and lower lubrication sheets each including a pair of graphite sheets and glass-based lubricant sandwiched therebetween, the hot deformation processing is performed while sandwiching the sintered body between the upper and the lower lubrication sheets, and the glass-based lubricant is a glass powder.

2. The method for manufacturing a rare-earth magnet according to claim 1, wherein in the second step, the upper and lower lubrication sheets are attached to the side faces of the lower punch and the upper punch, respectively, facing the cavity.

3. The method for manufacturing a rare-earth magnet according to claim 1, wherein in the second step, the upper and lower lubrication sheets are attached to upper and lower faces of the sintered body, respectively.

* * * * *